2/4/86 OR 4,568,943

United States Patent [19]

Bowman

[11] Patent Number: 4,568,943

[45] Date of Patent: Feb. 4, 1986

[54] ANTENNA FEED WITH MODE CONVERSION AND POLARIZATION CONVERSION MEANS

[75] Inventor: David F. Bowman, Moorestown, N.J.

[73] Assignee: RCA Corporation, Princeton, N.J.

[21] Appl. No.: 499,396

[22] Filed: May 31, 1983

[51] Int. Cl.[4] ..... H01Q 15/24; H01Q 13/02

[52] U.S. Cl. ..... 343/756; 343/786; 343/783; 333/21 R; 333/21 A; 333/137

[58] Field of Search ..... 333/21 R, 21 A, 137, 333/135, 248, 251, 26; 343/783, 784, 785, 786, 909, 756, 781 R, 753

[56] References Cited

U.S. PATENT DOCUMENTS

| | | | |
|---|---|---|---|
| 2,511,610 | 6/1950 | Wheeler | 333/243 |
| 2,669,657 | 2/1954 | Cutler | 343/783 |
| 2,762,982 | 9/1956 | Morgan, Jr. | 333/251 X |
| 2,979,679 | 4/1961 | Ellis | 333/21 A X |
| 3,521,288 | 7/1970 | Schell | 343/781 R |
| 3,611,396 | 10/1971 | Jones, Jr. | 343/786 X |
| 3,624,655 | 11/1971 | Sato et al. | 343/756 |
| 3,750,182 | 7/1973 | Kernweis | 343/783 |
| 3,754,271 | 8/1973 | Epis | 343/909 |
| 3,831,177 | 8/1974 | Soong | 343/786 |
| 4,141,015 | 2/1979 | Wong et al. | 343/786 |

OTHER PUBLICATIONS

"Dielectric-Loaded Horn Antenna", IEEE Transactions on Antennas and Propagation, Mar. 1972, pp. 199-201, by Toshio Satoh.

*Primary Examiner*—Eugene R. LaRoche
*Assistant Examiner*—Benny T. Lee
*Attorney, Agent, or Firm*—Joseph S. Tripoli; Robert L. Troike; Robert Ochis

[57] ABSTRACT

The configuration of a waveguide antenna feed is determined by a shaped body of solid dielectric material which is coated with a conductive material. The conductive material functions as a waveguide wall for constraining electromagnetic wave propagation within the dielectric body. The body includes a mode converter and a coupler to a lead-in structure. A polarization converter, if desired, can be integral with the dielectric body.

16 Claims, 15 Drawing Figures

ANTENNA FEED WITH MODE CONVERSION AND POLARIZATION CONVERSION MEANS

This invention relates to the field of antennas and more particularly to feeds for antennas.

My related patent application entitled "SELECTIVE WAVEGUIDE MODE CONVERTER", Ser. No. 499,395 co-filed with this application and is incorporated herein by reference.

Direct broadcast satellites are expected to become a significant source of video programs for home viewing. In order to make the signals from these satellites available to as many homes as possible, reliable, high quality, mass produceable, inexpensive receiving antennas are needed. These antennas are expected to be of the reflective dish type.

Such an antenna comprises essentially three parts—a reflector, a feed for receiving the signal from the reflector and a mounting mechanism which supports the feed in proper relation to the reflector. Typical prior art waveguide feeds for these antennas have complicated waveguide structures which require assembly to close tolerances for optimum performance. This requires substantial labor in assembly and test. All of this combines to render such a feed expensive and difficult to assemble and align.

To minimize antenna installation expenses, an antenna is needed which is inexpensive to make and suitable for installation by purchasers without special mechanical or electronic skills. In particular, the antennas need to operate properly without complicated electrical adjustment following installation. A waveguide feed is needed which is relatively simple and inexpensive to fabricate, which requires minimal field adjustment and which provides high quality reception.

In accordance with one embodiment of the present invention such a feed comprises a shaped body of solid dielectric material having a layer of conductive material disposed thereon in a configuration determined by the exterior surface of the dielectric body. This conductive layer comprises the waveguide of the feed. The feed has a radiating end, a coupling end, a coupler, a mode converter and if needed, a polarization converter. The coupler is in the vicinity of the coupling end of the feed and provides coupling between waves propagating in the dielectric body and signals propagating in a lead-in structure. The mode converter is located intermediate the ends of the dielectric body and is preferably for converting, to a beam shaping mode, a part of the energy in a fundamental mode wave propagating in the dielectric body. The polarization converter, if present, is in the vicinity of the radiating end of the feed and is for converting between linear and circular polarizations.

Figure 1:
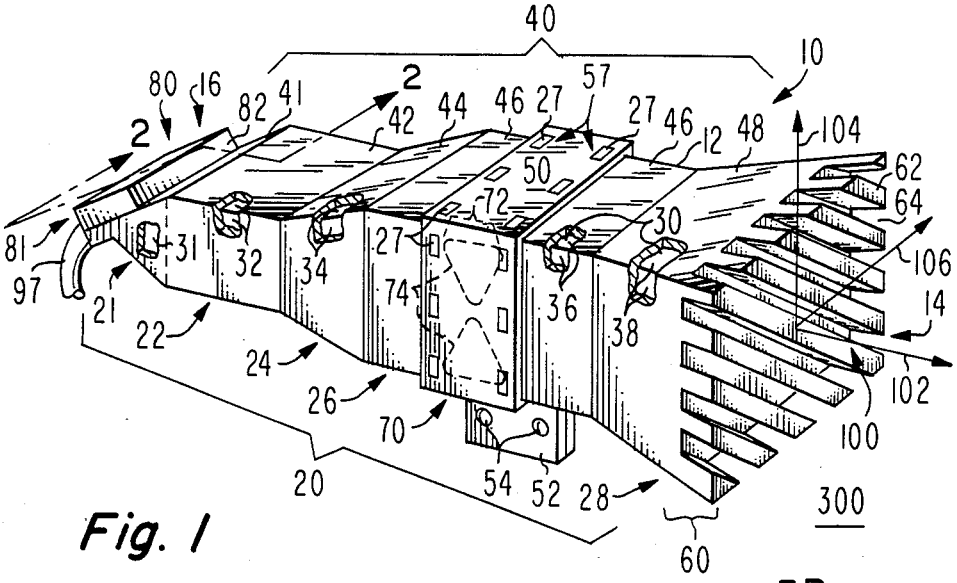
FIG. 1 is a perspective view of a feed in accordance with the invention.

A waveguide feed 10 in accordance with the invention is illustrated in perspective in FIG. 1. This feed is suitable for use with a reflector (not shown). It may also be used separately as a radiating element without a reflector. The feed 10 has a radiating end 14 toward the right in FIG. 2 and a coupling end 16 toward the left in FIG. 1. An associated co-ordinate system 100 has three mutually perpendicular axes 102, 104 and 106. The axis 102 is collinear with the longitudinal axis of feed 10.

The feed 10 comprises a body 20 of solid dielectric material which fills a waveguide 12. The body 20 is preferably a unitary structure having a plurality of shaped sections 21, 22, 24, 26 and 28 and has an exterior lateral surface 30 extending from a radiating end to a coupling end. Lateral surface 30 of body 20 has a compound contour which follows the shapes of the sections of body 20. Beginning at end 16 body 20 has a shaped coupling section 21 which has an exterior surface 31. The shape of section 21 is determined in accordance with coupling requirements. Section 21 merges into a section 22 of uniform rectangular cross-section which has an exterior surface 32. Surface 32 has two major planar portions disposed parallel to axis 104 and two other major planar portions disposed parallel to axis 106. Section 22 merges into a flared section 24 having an exterior surface 34 which flares outward in the directions of axes 104 and 106. Section 24 merges into a second uniform rectangular cross-section section (26) which has a larger cross-section than section 22 and an exterior surface 36 having major portions parallel to the major portions of surface 32. Section 26 merges into another flared rectangular section 28 which has an exterior surface 38. Section 28 terminates at the radiating end 14 of feed 10. The surfaces 31, 32, 34, 36 and 38 together comprise the exterior lateral surface 30.

A layer 40 of conductive material is disposed on the lateral surface 30 on all sides of the body 20, but not on the radiating end face 14 and not on selected portions at the coupling end 16. Layer 40 may be applied by electrolessly plating the surface 30 with an appropriate conductive material. The conductive layer 40 is formed in a tubular configuration having an interior surface which conforms to the contours of the exterior lateral surface 30 of the dielectric body 20. This tubular conductive layer 40 is effective as a waveguide wall of waveguide 12 and constrains the propagation of electromagnetic waves within the dielectric body 20. The waveguide 12 has sections 41, 42, 44, 46 and 48 whose shapes are determined by sections 31, 32, 34, 36 and 38, respectively, of the exterior lateral surface 30 of body 20.

A polarization converter 60 is located in the vicinity of the radiating end 14 of the body 20 within the large flared section 48 of the waveguide. The polarization converter 60 comprises interleaved strata 62 and 64 of slab-like regions. The regions 62 may preferably be formed from the same dielectric material as the rest of body 20 and thus will preferably have the same dielectric constant as the rest of body 20. The intervening regions 64 have a dielectric constant which is different from that of the regions 62. The slab-like regions 62 and intervening regions 64 are preferably between 0.7 and 1.4 wavelengths thick at a frequency in the designed operating frequency range of the feed. Each of the slabs 62 and intervening regions 64 (except the corner ones) have opposed major surfaces disposed parallel to the axis of propagation 102 within the waveguide of the feed 10. These major surfaces of the slab-like members are oriented at substantially a 45° angle to the major faces of the rectangular section 26 of body 20. As is known, from literature such as *Antenna Engineering Handbook* by Henry Jasik, 1961 Edition, McGraw Hill, Chapter 17 pages 21 and 22, a structure of this type is effective for converting linearly polarized waves within the dielectric body 20 which have their E-field disposed parallel to one of the major faces of section 26 into circularly polarized waves propagating in the external medium 300 in which the feed is situated. In FIG. 1, waves within the dielectric body having their E-field parallel to the axis 104 will be converted to right hand circularly polarized waves where right hand circularly polarized means clockwise rotation of the field vector as viewed looking in the positive 102 axis direction for a wave propagating in that direction. For linearly polarized waves having an E-field orientation parallel to the axis 106, the polarization converter will generate left hand circularly polarized waves.

A mode converter 70 is disposed within the body 20 intermediate its ends 14 and 16. In this embodiment the mode converter is within uniform cross-section section 26 of body 20. But the uniformity of this section is not essential to proper operation of the invention. This mode converter is for the purpose of converting part of the energy of a wave propagating in a first mode (which may be the fundamental $TE_{10}$ mode) within waveguide 40 from the coupling end 16 toward the radiating end 14 into a desired second mode (which may be a beam shaping mode such as the higher order $LSE_{12}$ mode). A wave within the waveguide 40 which is a combination of the fundamental $TE_{10}$ mode and an appropriate amount of the higher order $LSE_{12}$ mode in proper relative phase provides the feed with substantially lower sidelobe transmission or reception characteristics than does a $TE_{10}$ mode alone. This provides more effective concentration of useful illumination on the reflector.

The mode converter 70 preferably comprises a region 72 having a different effective dielectric constant than the rest of body 20. The region 72 extends cross-wise to the axis of propagation 102 of the waveguide and has a thickness parallel to the axis of propagation 102 which varies with position across the waveguide. The axial thickness of the dielectric at each point across the waveguide is proportional to the ratio of the maximum amplitude of the desired added mode ($LSE_{12}$) to the maximum amplitude of the initial mode ($TE_{10}$) both at that point. In FIG. 1 the region 72 of mode converter 70 comprises a pair of through holes 74 which extend through the body 20 parallel to axis 106. These holes 74 have a width in direction 102 which varies across the waveguide in the direction 104 as a cosine wave which has a single period within the waveguide 12. The width of these holes in direction 102 does not vary across the waveguide in the direction 106. The conductive layer 40 does not extend across the ends of the holes 74. The holes 74 are large enough that this absence of the conductive layer 40 would interfere with the waveguide wall effect of that layer at at least some frequencies within the operating frequency range of the feed 10.

A conductive (metal) bracket 50 fits over the body 20 and the conductive layer 40 in the vicinity of the mode converter 70. Bracket 50 forms a tightly fitting collar which makes electrical contact to the layer 40, thereby serving as a waveguide wall across the ends of the holes 74. In this way, the waveguide effect is not lost at the holes 74. The bracket 50 includes a flange 52 extending away from the body 20. This flange 52 includes mounting holes 54 for securing the bracket to a feed support mechanism (not shown). The flange 52 may be positioned along the center of a side of the body 20 as illustrated in FIG. 1 or at other positions such as at corners. The particular position chosen depends on the desired orientation of the feed 10 relative to the feed support structure (not shown) to which flange 52 is attached.

Bracket 50 also serves to provide increased structural strength to body portion 26 which can be weakened by the large through holes 74 which comprise region 72. Further support is provided by alignment projections 27 on body portion 26 and mating alignment holes 57 in bracket 50. These holes and projections interlock to align bracket 50 and body 20 in a desired fixed relative position. With a properly designed mount, this ensures that an unskilled individual can install an antenna system with the assurance that it will be properly aligned. Although not preferred, if desired, the region 72 may be a single hole or void in body 20 which extends completely through body 20 and separates it into a coupling-end portion and a radiating-end portion. These two portions are then held in fixed relation by the mating alignment structures on body 20 and bracket 50.

Waves propagating in the body 20 with their polarization parallel to the axis 104 are coupled to a coaxial lead-in 97 by a coupler 80 in the vicinity of the coupling end 16 of the body 20.

Figure 2:
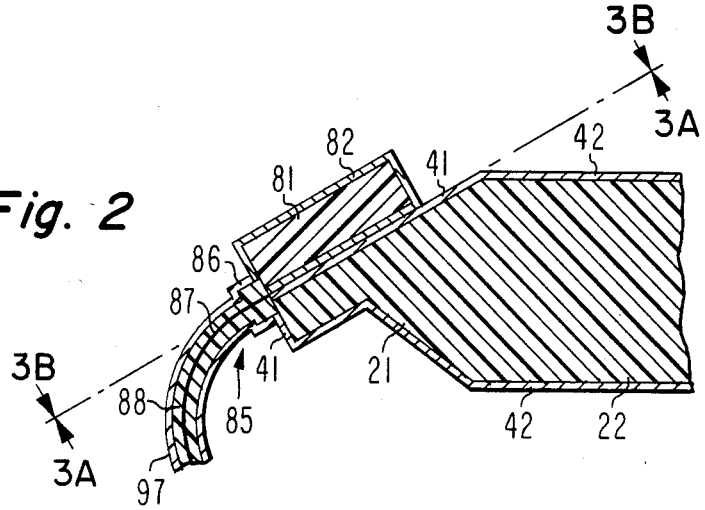
FIG. 2 is a cross-sectional view of a coupling portion of the FIG. 1 structure.
Figure 3A:
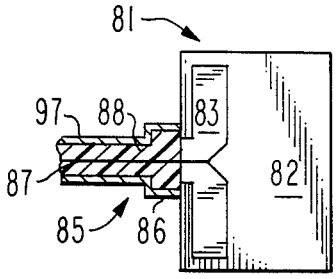
FIGS. 3A and 3B are cross-sectional views of the structure of FIG. 2.
Figure 3B:
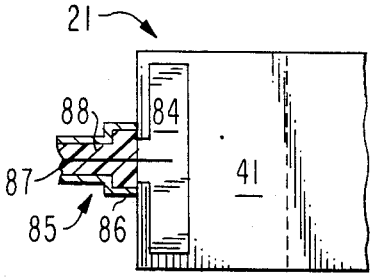

The structure of the coupler 80 is illustrated in greater detail in FIGS. 2, 3A and 3B. Coupler 80 preferably comprises a body 81 of solid dielectric material having the same dielectric constant as the material of body 20. The body 81 has a conductive layer 82 covering all of the exterior surface thereof except for a portion 83. The non-coated portion 83 of the surface of body 81 includes portions facing portion 21 of body 20 and a coaxial coupler or connector 85. The configuration of the non-metallized region 83 is best seen in the view of FIG. 3A. A mating non-metallized region 84 of the surface of body 20 faces body 81. Region 84 is illustrated in FIG. 3B. The combined structure of body 81 and the coupling portion 21 of body 20 has the coaxial connector 85 affixed thereto. Connector 85 has an outer conductor 86 which is connected to the conductive layers 41 and 82. An inner conductor 87 extends from within the coaxial structure between and across the non-metallized regions 83 and 84 to contact the conductive regions 82 and 41 which are preferably in direct electrical contact with each other. The coaxial connector has a dielectric 88 spacing apart the inner and outer conductors. Body 81 functions as a stub waveguide electrically connected to the end of coupling portion 21 of body 20. In the illustrated configuration, this stub waveguide is folded back against the body 21 for compactness and structural strength. The inner conductor 87 of the coaxial connector which extends across the non-metallized regions 83 and 84 functions as an E-plane probe for coupling between vertically polarized (parallel to axis 104) waves propagating in the waveguide 40 and waves propagating in a coaxial lead-in 97 attached to coax connector 85.

The structure of coupler 80 has been illustrated and described as though the body 81 were separate from the coupling portion 21 of body 20. The coupler 80 may be fabricated in that manner. Alternatively, the portions of conductive layers 41 and 82 which face and contact each other along the section line 3A—3A, may instead be formed of a conductive member which is mounted in a mold for the body 20 prior to molding the body 20. Body portion 81 is then formed in the same molding step as the rest of body 20. This provides a feed 10 in which the body portion 81 is an integral part of body 20.

Figure 4:
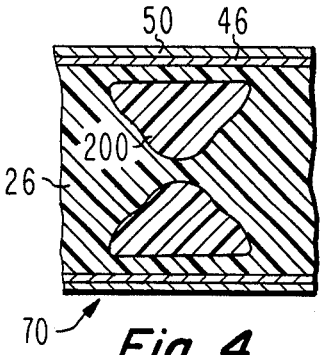
FIGS. 4 through 7 illustrate different means of providing a mode converter in the feed of FIG. 1.

In FIGS. 4–7 alternative configurations of the region 72 of the mode converter 70 are illustrated. In FIG. 4, region 72 is filled with a solid dielectric 200 having a different dielectric constant than the rest of body 20. With the holes 74 filled with a solid dielectric, the conductive layer 40 may extend across those holes as a continuous layer. This obviates the need for bracket 50 from waveguide continuity considerations. However, such a bracket may still be the most effective way of mounting the feed 10.

Figure 5:
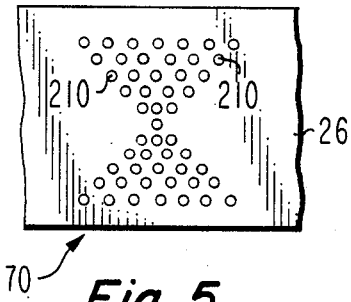

In FIG. 5 the large through holes 74 are replaced by many smaller through holes 210 which extend all the way through the dielectric body 20 parallel to axis 106. These holes 210, like holes 74, may be left "empty" (i.e. filled with air) or may be filled with a solid dielectric which has a different dielectric constant than the rest of body 20. The net effect of these holes 210 in the dielectric of body 20 is to create a region having an effective dielectric constant which is intermediate that of the dielectric of body 20 and that within the holes 210.

Figure 6:
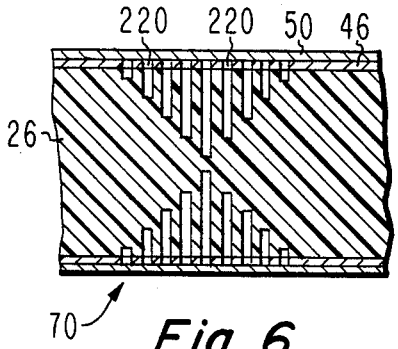

In FIG. 6 the region 72 comprises a number of blind holes 220 which extend into the dielectric body 20 parallel to axis 104. The number and length of the holes 220 is selected to produce a region 72 of different effective dielectric constant which has the thickness profile required for generation of the desired higher order mode. If desired, the holes 220 may be tapered in diameter (getting narrower the further into body 26 they penetrate). This facilitates the removal of the mold for body 20 where the holes 220 are molded into the dielectric body.

The holes 210 of FIG. 5 and 220 of FIG. 6 are small enough that the absence of conductive layer 40 where they penetrate surface 30 does not interfere with the waveguide wall effect of layer 40. Consequently, if such a mode conversion region is used in feed 10, the bracket 50 is not required by waveguide continuity considerations.

If the dielectric constant within the regions 200, 210, and 220 in the mode converters of FIGS. 4, 5 and 6, respectively are less than that of the body 26, then each of these mode converters generates the $LSE_{12}$ mode with a phase lead of 270° relative to the $TE_{10}$ mode. Thus, for the $LSE_{12}$ and $TE_{10}$ modes to be in-phase at radiating end 14 as is desirable, the $LSE_{12}$ mode must accumulate another 90° of lead as a result of its higher propagation velocity in the waveguide.

Figure 7:
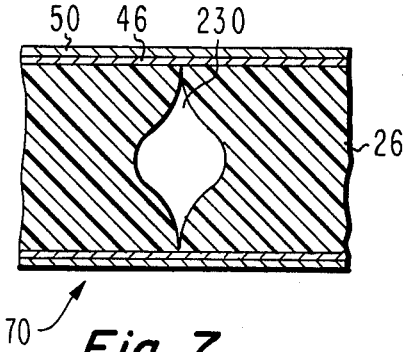

In FIG. 7, the region 72 comprises a single through hole 230 having its greatest axial extent along the centerline of the waveguide. This mode converter generates the $LSE_{12}$ mode with a lead of 90° relative to the $TE_{10}$ mode. Consequently a longer waveguide is needed between it and aperture 14 to place the $LSE_{12}$ and the $TE_{10}$ modes in-phase at the aperture (total additional lead or drift needed being 270°).

Additional details on the operation of mode converters of this type is contained in my application entitled, "SELECTIVE WAVEGUIDE MODE CONVERTER" mentioned above.

Figure 8:
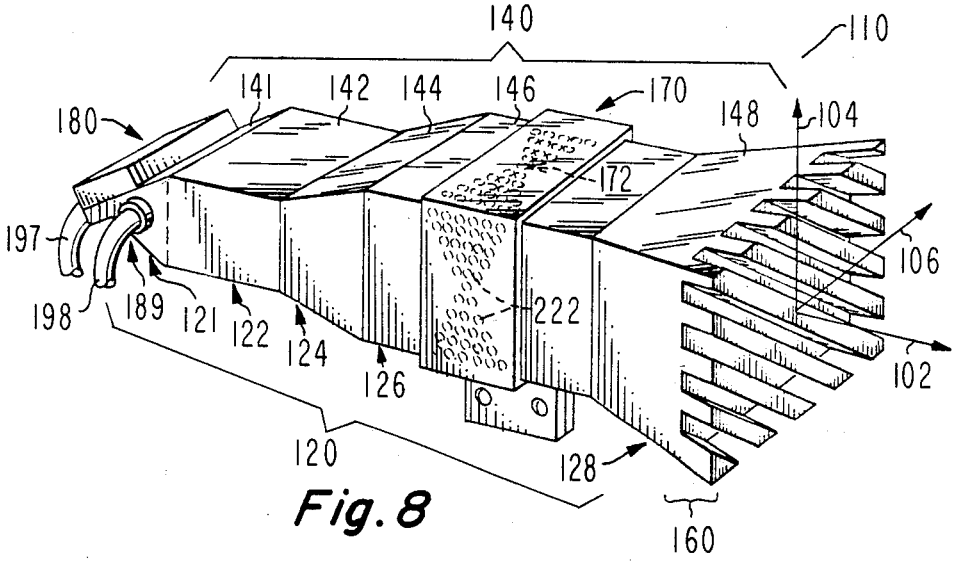
FIG. 8 is an alternate embodiment of a feed in accordance with the invention which is capable of handling two different polarizations.

The feed 10 of FIG. 1 is effective for handling right hand circularly polarized waves impinging on the radiating end 14 of the feed 10. The polarization converter 60 converts these waves to linearly polarized waves having their E-field parallel to the axis 104. These waves propagate through the feed waveguide 12, enter the coupler 80, and are coupled into the lead-in 97. This feed 10 would instead handle left hand circularly polarized incident waves if the polarization converter 30 were rotated 90° about the propagation axis 102. However, this feed can not handle both polarizations simultaneously.

Where it is desirable to handle both right and left circularly polarized incident waves, the feed 110 of FIG. 8 is preferred. Feed 110 may be identical to the feed 10 of FIG. 1 with the exception of its mode converter and its couplers. Because both polarizations will be utilized, the profile of the mode converter 160 of feed 110 must vary across the waveguide in directions parallel to both axis 104 and axis 106. As illustrated in FIG. 8, this may preferably be accomplished through the use of blind holes 222 similar to the blind holes 220 of the mode converter of FIG. 6. Holes 222, like holes 220, are small enough that a covering bracket is not essential for proper waveguide operation.

Figure 9:
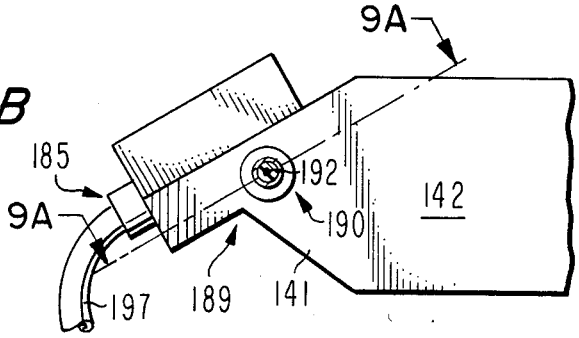
FIG. 9 illustrates a portion of a coupling structure of FIG. 8.
Figure 9A:
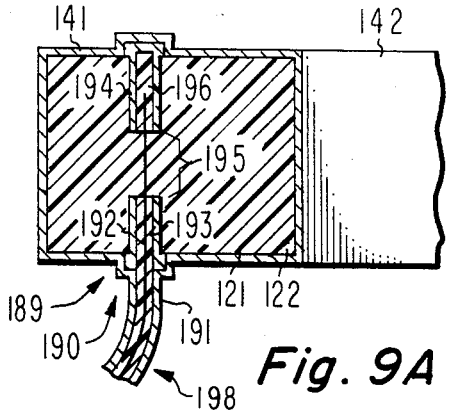
FIG. 9A is a cross-sectional view of the structure of FIG. 9.

Couplers 180 and 189 at the coupling end 16 of the feed 110 are configured to selectively couple those waves having their E-fields parallel to the axes 104 and 106, respectively, to separate lead-ins 197 and 198, respectively. The structure of the coupler 180 may be substantially identical to the structure of the coupler 80 of feed 10. The structure of the coupler 189 is shown in greater detail in FIGS. 9 and 9A. The coupler 189 is of the E-plane probe type and is oriented perpendicular to the coupler 180. This coupler comprises a coaxial connector 190 having an outer conductor 191, an inner conductor 192 and a separating dielectric 193. The outer conductor 191 extends into the portion 121 of body 120 in alignment with a second outer conductor 194 which extends into the body portion 121 from the opposite side of the body. Outer conductors 191 and 194 are spaced from each other by a gap 195. The inner conductor 192 extends across the gap 195 between the outer conductors 191 and 194 and into a separating dielectric 196 within the outer conductor 194. The portion of the inner conductor 192 which is located in the gap 195 comprises the E-plane probe of the coupler 189. This probe couples between waves propagating in the waveguide 141 with a horizontal linear polarization (parallel to axis 106) and waves propagating in a coaxial lead-in 198.

Separate receivers may be provided for each of the lead-ins 197 and 198, if desired. Alternatively, a single receiver may be switched between these two lead-ins. The use of two separate receivers provides greater versatility in programming reception while the use of a single switched receiver provides a less expensive system. In a direct broadcast satellite application, it may be desirable to place the receiver or down-converter circuitry in close proximity to the feed to reduce propagation losses.

Figure 10A:
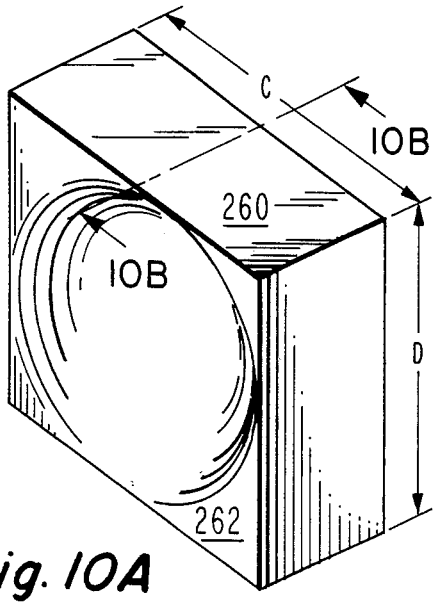
FIGS. 10A, 10B, 11A and 11B, illustrate alternative means of providing the mode converter in the feed of FIG. 8.
Figure 11A:
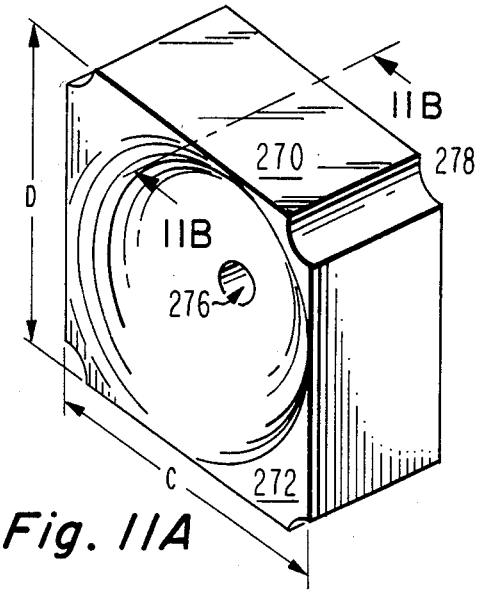
Figure 10B:
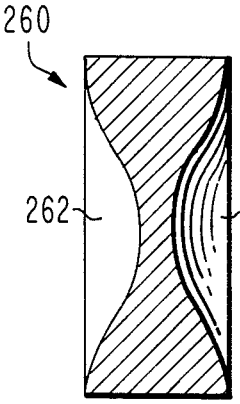
Figure 11B:
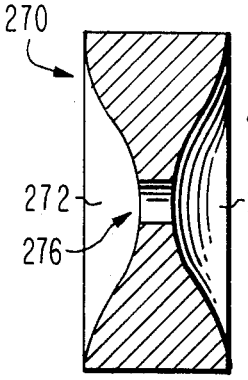

In FIGS. 10A and 11A, alternative configurations for the mode converter region 172 of the mode converter 170 of feed 110 are illustrated. Cross sections through these respective mode converter regions are illustrated in FIGS. 10B and 11B. In FIG. 10A the mode converter region 172 comprises a body 260 of solid dielectric material which has a thickness in direction 102 which varies across the waveguide parallel to both the axis 104 and the axis 106 as a full cycle of a cosine function. The faces 262 and 264 (FIG. 10B) of body 260 are surfaces of revolution and thus may be easily formed by machining or molding. The body 260 has a different dielectric constant than that of the dielectric of body 120. The body 260 may be mounted in a mold for the body 120 prior to the molding of the body 120. In this manner, the body 260 is incorporated into the molded body 120 of the feed 110. Such a procedure requires good adhesion between the material of the body 260 and the material of the remainder of the body 120.

A mode conversion region 270 which is a variation on the mode conversion region 260 is illustrated in FIGURE 11A. Body 270 is similar to body 260 and may be formed of the same material. It differs from body 260 in that there is an axial through hole 276 on the axis of the waveguide and there are cutouts 278 at the corners of the block 270. The hole 276 and the cutouts 278 provide increased structural connection of the portions of the body 120 to the right of and to the left of the mode converter 170 in the FIG. 8. The exterior dimensions C and D of bodies 260 and 270 are preferably less than the corresponding dimensions of body 120. During molding of body 120 this results in body 260 or body 270 being completely surrounded by the same material which forms the rest of body 120. This provides a single continuous lateral exterior surface 130 on body 120. This provides uniform adhesion characteristics for the conductive layer 140 over the entire body 120 and minimizes the problem of separation of the body 260 or 270 from the remainder of the body 120. The chances for such separation are further reduced by forming the body 260 or 270 of a material which has the same coefficient of thermal expansion as the material selected for the remainder of the body 120. In this manner, thermal cycling will not induce stresses which would be likely to cause separation between the body 120 and the body 260 or 270.

The flared or tapered structure of waveguide 140 (or 40) provides better feed performance than would be provided by a waveguide which has a uniform cross-section throughout its length. However, fabrication of a waveguide having the configuration of waveguide 140 from self-supporting tubular metal members is a demanding and expensive process. In that process the flares must be individually formed and then joined to the uniform cross-section portions.

The structure of feed 110 (or 10) eliminates these fabrication problems. Feed 110 is fabricated by first forming the dielectric body 120 (preferably by molding). The formed body 120 is coated with the conductive layer 140 which need not be self-supporting since it adheres to body 120 which determines the configuration of its interior surface. All of the features of body 120 including the polarization converter, the mode converter and the portions of the couplers within body 120 may be formed in a single molding step which also forms the exterior lateral surface 130. This makes the feed 110 inexpensive to fabricate and eliminates the fabrication and assembly costs of using a formed metal waveguide. If solid dielectric inserts such as 260 or 270 are used, they may be separately formed and inserted in the mold for body 120 prior to the molding of body 120. Feed 10 is preferably fabricated in a similar manner. The unitary structure of the feeds 10 and 110 eliminates any need for post-fabrication adjustment of the feed as occurs with complicated waveguide feeds.

If it is desired to utilize a feed in accordance with this invention for the reception or transmission of signals which are linearly polarized rather than circularly polarized, then either feed 10 or the feed 110 may be fabricated without its polarization converter (60 or 160). If waveguide lead-ins are desired instead of coaxial lead-ins, then the coupling section 121 and the couplers 180 and 189 may be replaced by a waveguide hybrid junction which couples the two polarizations into separate waveguide lead-ins. With appropriate modifications from the illustrated and described compound contour, rectangular cross-section waveguide embodiment, the invention may be used with round or other non-rectangular cross-section waveguides and constant cross-section waveguides.

What is claimed is:

1. An antenna feed of the waveguide type for operation over an operating range of frequencies comprising:

a body comprising a solid dielectric material having a given dielectric constant, said body having a radiating end, a coupling end and an exterior lateral surface therebetween;

a layer of conductive material formed on said exterior lateral surface of said body in a tubular configuration having an interior surface which conforms to said exterior lateral surface of said dielectric body, said tubular layer of conductive material being effective as waveguide wall for constraining the propagation of electromagnetic waves within said dielectric body;

a mode converter located within said body between said coupling end and said radiating end for selectively converting to a second mode a part of the energy in a wave propagating in a first mode from said coupling end toward said radiating end, said mode converter having a converter dielectric constant having a different value than said given dielectric constant, said mode converter having a thickness in the direction of wave propagation in said body and a thickness profile across said body which is proportional to the amplitude profile across said body of said second mode; and means for coupling between a linearly polarized first mode wave propagating in said dielectric body of said feed and a signal propagating in a lead-in structure, said means for coupling being disposed in the vicinity of said coupling end.

2. The feed recited in claim 1 further comprising a polarization converter in the vicinity of said radiating end for converting between linearly polarized waves propagating in said body and circularly polarized waves propagating in an external medium.

3. The feed recited in claim 2 wherein:

said dielectric body is a unitary structure;

said polarization converter is integral with said body; and said mode converter is integral with said body.

4. The feed recited in claim 1 wherein:

said converter comprises a host region of said body having said given dielectric constant and a plurality of modifier regions having a third dielectric constant different than said given and said converter dielectric contants, said modifier regions dispersed in said host region, the combination of said modifier regions and said host region providing an effective constant of said converter value.

5. An antenna feed of the waveguide type for operation over an operating range of frequencies comprising:

a body comprising a solid dielectric material having a given dielectric constant, said body having a radiating end, a coupling end and an exterior lateral surface therebetween;

a layer of conductive material formed on said exterior lateral surface of said body in a tubular configuration having an interior surface which conforms to said exterior lateral surface of said dielectric body, said tubular layer of conductive material being effective as a waveguide wall for constraining the propagation of electromagnetic waves within said dielectric body;

a mode converter located within said body between said coupling end and said radiating end for selectively converting to a second mode a part of the energy in a wave propagating in a first mode from said coupling end toward said radiating end;

said mode converter including a converter region within said body having a converter dielectric constant, said converter dielectric constant having a value which is lower than the value of said given dielectric constant;

said lower value of said converter dielectric constant resulting from at least one void in the dielectric material of said body;

said at least one void extending to an external surface of said body; and means for coupling between a linearly polarized first mode wave propagating in said dielectric body of said feed and a signal propagating in a lead-in structure, said means for coupling being disposed in the vincinity of said coupling end.

6. The feed recited in claim 5 wherein:

said layer of conductive material is supported by said exterior lateral surface and is absent where said at least one void extends to said external surface;

said at least one void is large enough to interfere with the waveguide effect of said conductive material at a frequency within said operating range of frequencies; and said feed further comprises a conductive member extending across said at least one void adjacent said external lateral surface, said conductive member being disposed in electrical contact with said conductive layer whereby said member is effective for maintaining the waveguide effect of said conductive layer across said at least one void.

7. The feed recited in claim 6 wherein:

said conductive member includes means for mounting said member to an external support.

8. The feed recited in claim 7 wherein:

said body and conductive member include mating alignment structures for fixing the relative position of said body and said member.

9. The feed recited in claim 7 wherein:

said member extends substantially completely around said exterior lateral surface.

10. The feed recited in claim 5 further comprising:

a self-supporting conductive member extending across said void and electrically contacting said conductive layer;

said self-supporting conductive member including means for mounting said member to a feed support.

11. The feed recited in claim 1 further comprising:

a support member fixed to said body;

said support member including means for mounting said member to a feed support.

12. The feed recited in claim 1 wherein:

said means for coupling comprises a first E-plane probe for coupling between a first lead-in structure and waves propagating in said body in a first linear polarization and a second E-plane probe for coupling between a second lead-in structure and waves propagating in said body in a second linear polarization substantially perpendicular to said first linear polarization.

13. The feed recited in claim 12 wherein:

the configuration of said converter is substantially the same in the plane of said first linear polarization as it is in the plane of said second linear polarization whereby the proportion of the energy in a first mode wave having said first polarization which is converted to said second mode is substantially the same as the proportion of the energy in a first mode wave having said second polarization which is converted to said second mode.

14. The feed recited in claim 13 wherein:

said waveguide has a rectangular cross-section;

each of said first modes is a $TE_{10}$ mode; and each of said second modes is an $LSE_{12}$ mode.

15. The feed recited in claim 2 wherein said polarization converter comprises:

interleaved first and second regions, said first regions having a first dielectric constant and said second regions having a second, lower, dielectric constant, the transitions between said first and second regions comprising a set of parallel planes whereby each of said first regions which is bounded by two adjacent second regions has a substantially constant thickness in a first direction perpendicular to the direction of propagation and each of said second regions which is bounded by two adjacent first regions has a substantially constant thickness in said first direction, each of said first and said second regions having a length in the direction of propagation of substantially 0.7 to 1.4 wavelengths at a frequency in said operating range, and said set of parallel planes being oriented at substantially 45° to the plane of the E-field of the linearly polarized wave.

16. The feed recited in claim 1 wherein:

said body has a smaller cross-section at said mode converter than at said radiating end; and a portion of said body between said mode converter and said radiating end flares from said smaller cross-section to said larger cross-section.

* * * * *